US008393618B2

(12) United States Patent
Nakada et al.

(10) Patent No.: US 8,393,618 B2
(45) Date of Patent: Mar. 12, 2013

(54) SKEW CORRECTION DEVICE, SHEET HANDLING APPARATUS, AND IMAGE FORMING SYSTEM

(75) Inventors: Kyosuke Nakada, Kanagawa (JP); Masahiro Tamura, Kanagawa (JP); Shuuya Nagasako, Kanagawa (JP); Tomohiro Furuhashi, Kanagawa (JP); Keisuke Sugiyama, Tokyo (JP); Yuusuke Shibasaki, Kanagawa (JP); Junya Suzuki, Miyagi (JP); Yasuo Niikura, Miyagi (JP); Kazunori Konno, Miyagi (JP); Tomomichi Hoshino, Kanagawa (JP); Akira Kunieda, Tokyo (JP); Takahiro Watanabe, Kanagawa (JP); Tomohiro Yoshizaki, Saitama (JP); Kiichiro Goto, Kanagawa (JP); Kazuya Yamamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/448,640

(22) Filed: Apr. 17, 2012

(65) Prior Publication Data

US 2012/0267846 A1 Oct. 25, 2012

(30) Foreign Application Priority Data

Apr. 19, 2011 (JP) ..... 2011-093160

(51) Int. Cl.
*B65H 7/02* (2006.01)

(52) U.S. Cl. ..... 271/227; 271/242; 271/244

(58) Field of Classification Search ..... 271/226, 271/227, 242, 244; 270/58.12, 58.16, 58.17, 270/58.27
See application file for complete search history.

(56) References Cited

U.S. PATENT DOCUMENTS

| | | | | |
|---|---|---|---|---|
| 5,240,241 | A * | 8/1993 | Kawazoe | 271/114 |
| 5,556,086 | A * | 9/1996 | Munneke et al. | 270/46 |
| 6,834,853 | B2 * | 12/2004 | Trovinger et al. | 271/227 |
| 7,219,888 | B2 * | 5/2007 | Trovinger et al. | 271/227 |
| 7,681,881 | B2 | 3/2010 | Kunieda et al. | |
| 7,802,789 | B2 | 9/2010 | Tokita et al. | |
| 7,905,473 | B2 | 3/2011 | Tamura et al. | |
| 7,950,655 | B2 * | 5/2011 | Park et al. | 271/261 |
| 2009/0066003 | A1 | 3/2009 | Kunieda et al. | |
| 2009/0200725 | A1 | 8/2009 | Tamura et al. | |
| 2009/0206547 | A1 | 8/2009 | Tokita et al. | |
| 2011/0184889 | A1 | 7/2011 | Tokita et al. | |
| 2011/0277418 | A1 | 11/2011 | Kunieda et al. | |

FOREIGN PATENT DOCUMENTS

| | | | |
|---|---|---|---|
| JP | 10-301347 | A | 11/1998 |
| JP | 4016621 | B2 | 3/2003 |

* cited by examiner

*Primary Examiner* — Jeremy R Severson
(74) *Attorney, Agent, or Firm* — Harness, Dickey & Pierce, P.L.C.

(57) ABSTRACT

A skew correction device includes a first conveying unit arranged in a sheet conveying path; a second conveying unit arranged downstream of the first conveying unit in a conveying direction of a sheet; and a skew correction unit. When the sheet is unfolded paper, the skew correction unit performs a first skew correction that corrects for the skew of the sheet so that a leading edge of the sheet conveyed by the first conveying unit abuts on the second conveying unit that is stopped. When the sheet is fold paper, the skew correction unit performs a second skew correction that corrects for the skew of the sheet so that a leading edge of the sheet conveyed by the first conveying unit abuts the second conveying unit and the second conveying unit is driven in a reverse direction to the conveying direction at a predetermined operational timing.

10 Claims, 12 Drawing Sheets

SKEW CORRECTION DEVICE, SHEET HANDLING APPARATUS, AND IMAGE FORMING SYSTEM

CROSS-REFERENCE TO RELATED APPLICATIONS

The present application claims priority to and incorporates by reference the entire contents of Japanese Patent Application No. 2011-093160 filed in Japan on Apr. 19, 2011.

BACKGROUND OF THE INVENTION

1. Field of the Invention

The present invention relates to a skew correction device, a sheet handling apparatus, and an image forming system.

2. Description of the Related Art

These days, various fold shapes are employed for sheets, and there is an increasing need to punch their surfaces. In particular, sheets of offset z-fold paper are widely practiced, and punching their surfaces is frequently performed as a matter of course. Because positional accuracy of the punching is essential at this time, many inventions for improving the positional accuracy have been developed.

One aspect of correction for improving the positional accuracy is skew correction. Widely known as the skew correction is a method for correcting skew by causing a sheet to abut on stopped registration rollers, further rotating carriage rollers on the upstream thereof to form flexure, and rotating the registration rollers in the normal direction. However, this method fails to correct skew of z-fold paper stably.

Japanese Patent No. 4016621, for example, discloses a conveying device for providing skew correction without fail even if a sheet is nipped in a nip portion (registration rollers) of a downstream conveying unit, or the sheet gets stuck in a roller element. The conveying device includes a control unit that corrects skew distortion by reversely driving the downstream conveying unit at an operational timing close to an operational timing at which the leading edge of a conveyed body reaches the downstream conveying unit, and cancelling the reverse drive of the downstream conveying unit after a predetermined period of time elapses, and reversely drives the downstream conveying unit on condition that one side of the conveyed body be detected not to abut on the downstream conveying unit nearly evenly.

In the method for performing skew correction by reversely driving the registration rollers under the condition that a sheet be detected not to come into contact with (abut on) the registration rollers evenly as disclosed in Japanese Patent No. 4016621, the number of operations increases compared with the method in which a sheet is caused to abut on stopped registration rollers, thereby reducing the productivity.

In other words, conventionally, skew correction has been performed by reversely rotating the registration rollers on all sheets if skew occurs. In this correction method, however, it takes a long time to rotate the rollers reversely and to rotate the rollers normally thereafter. As a result, the productivity is reduced compared with the skew correction in which a sheet is caused to abut on the stopped registration rollers. In terms of a sheet of unfolded paper, only by causing the sheet to abut on the stopped registration rollers and to form flexure, an advantageous effect of skew correction can be obtained considerably. By contrast, in terms of a sheet of fold paper, such as offset z-fold paper, if the sheet is caused only to abut on the stopped registration rollers, the leading edge of the sheet is likely to be nipped unevenly because of folding defect and the thickness of the sheet. As a result, the advantageous effect of skew correction is less likely to be obtained, and fluctuation in the correction is large.

Therefore, there is a need for technology capable of improving skew correction performance for a sheet on which folding is performed without reducing the productivity of the sheet on which folding is performed.

SUMMARY OF THE INVENTION

It is an object of the present invention to at least partially solve the problems in the conventional technology.

According to an embodiment, there is provided a skew correction device that includes a first conveying unit arranged in a sheet conveying path; a second conveying unit arranged downstream of the first conveying unit in a conveying direction of a sheet; and a skew correction unit configured to control driving of the first conveying unit and the second conveying unit to correct for skew of the sheet. When the sheet is unfolded paper, the skew correction unit performs a first skew correction that corrects for the skew of the sheet so that a leading edge of the sheet conveyed by the first conveying unit abuts on the second conveying unit that is stopped. When the sheet is fold paper, the skew correction unit performs a second skew correction that corrects for the skew of the sheet so that a leading edge of the sheet conveyed by the first conveying unit abuts the second conveying unit and the second conveying unit is driven in a reverse direction to the conveying direction at a predetermined operational timing.

According to another embodiment, there is provided a sheet handling apparatus that includes the skew correction device according to the above embodiment.

According to still another embodiment, there is provided an image forming system that includes the skew correction device according to the above embodiment; and an image forming apparatus configured to form an image on the sheet.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are described below with reference to the accompanying drawings. The term "sheet" described below includes a piece of transfer paper, and a film-like paper sheet material.

1. Entire Configuration

Figure 1:
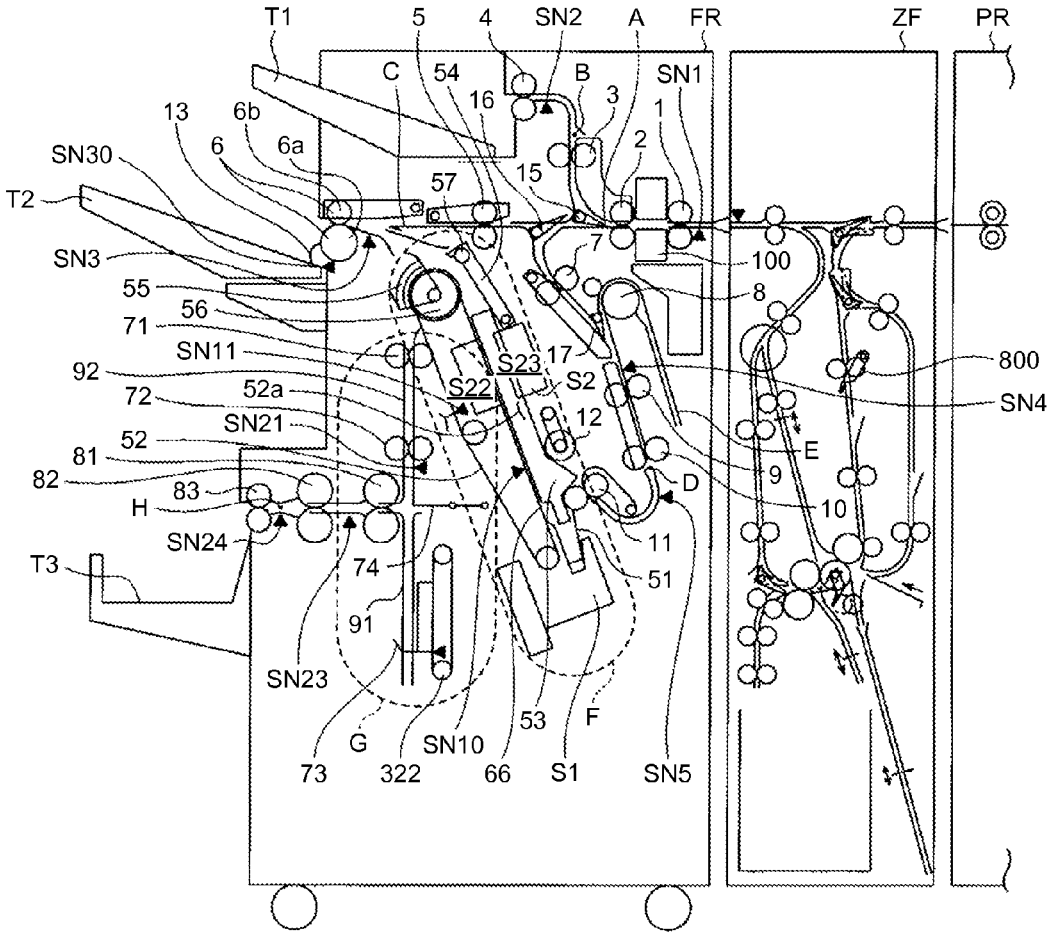
FIG. 1 is a schematic of an entire configuration of an image forming system according to an embodiment of the present invention.

FIG. 1 is a schematic of an entire configuration of an image forming system according to an embodiment of the present invention. In FIG. 1, the image forming system according to the present embodiment includes an image forming apparatus PR, a sheet post-processing apparatus FR serving as a sheet handling apparatus, and a folding apparatus ZF provided interposed therebetween.

In FIG. 1, the folding apparatus ZF is attached to the side of the image forming apparatus PR, and a sheet (sheet-like recording medium) ejected from the image forming apparatus PR is introduced into the folding apparatus ZF. The sheet post-processing apparatus FR is attached to the side (subsequent stage) of the folding apparatus ZF, and a sheet ejected from the folding apparatus ZF is introduced into the sheet post-processing apparatus FR. The sheet passes through a conveying path A having a post-processing unit (a punching device 100 in the present embodiment) that performs post-processing on one sheet, and is distributed to a conveying path B, C, or D by a bifurcating claw 15 and a bifurcating claw 16. The conveying path B is a conveying path that introduces a sheet into an upper tray (proof tray) T1. The conveying path C is a conveying path that introduces a sheet into a shift tray T2. The conveying path D is a conveying path that introduces a sheet into a processing tray F (hereinafter, also referred to as a staple processing tray) that performs processing, such as alignment and stapling.

A tray surface 66 of the staple processing tray F on which the sheets are stacked inclines with an end on the downstream side in a conveying direction of a sheet ejected from a staple ejecting roller 11 arranged upward. The inclination angle is set to the minimum angle at which the tray surface 66 does not interfere with mechanisms, such as a folding plate 74, a driving mechanism thereof, and an end surface binding stapler S1, which will be described later, arranged on the lower side of the inclined surface in the direction of gravitational force.

The sheet on which the processing, such as alignment and stapling, is performed in the staple processing tray F is distributed to the conveying path C or a processing tray G (hereinafter, also referred to as a center-folding tray) that performs processing such as folding by a bifurcating guide plate 54 and a movable guide 55 serving as a deflecting unit. The sheet on which the processing such as folding is performed in the center-folding tray G passes through a conveying path H, and is introduced into a lower tray T3 by an ejecting roller 83. A bifurcating claw 17 is arranged in the conveying path D, and is retained in the state illustrated in FIG. 1 by a low load spring, which is not illustrated. After a trailing edge of the sheet conveyed by a carriage roller 7 passes by the bifurcating claw 17, at least a guiding roller 8 and a carriage roller 9 are rotated reversely among the guiding roller 8, the carriage roller 9, a carriage roller 10, and the staple ejecting roller 11. As a result, the trailing edge of the sheet is introduced into a sheet reception unit E, and the sheet is accumulated therein, making it possible to convey the sheet together with a subsequent sheet in a stacked manner. By repeating this operation, it is possible to convey two or more sheets in a stacked manner.

In the conveying path A that is arranged on the upstream of the conveying paths B, C, and D, and is shared by the conveying paths, an entrance sensor SN1 that detects a sheet received from the image forming apparatus PR is arranged. On the downstream thereof, a pair of entrance rollers 1, the punching device 100, a carriage roller 2, the bifurcating claw 15, and the bifurcating claw 16 are arranged in order. The bifurcating claw 15 and the bifurcating claw 16 are retained in the state illustrated in FIG. 1 by a spring, which is not illustrated. By turning solenoids on, which are not illustrated, a free end of the bifurcating claw 15 rotates upward by a predetermined amount, and a free end of the bifurcating claw 16 rotates downward by a predetermined amount. As a result, the sheet is distributed to the conveying path B, the conveying path C, or the conveying path D. The pair of entrance rollers 1 is simply referred to as an entrance roller in the present embodiment.

To introduce the sheet into the conveying path B, because the conveying path A communicates with the conveying path B in the state illustrated in FIG. 1, the sheet is conveyed by carriage rollers 3 and 4 in this state, and is ejected to the proof tray T1. To introduce the sheet into the conveying path D, the solenoid of the bifurcating claw 15 is turned on in the state illustrated in FIG. 1. As a result, the free end of the bifurcating claw 15 is rotated upward by the predetermined amount, thereby causing the conveying path A to communicate with the conveying path D. Thus, the sheet is conveyed along the conveying path D by the carriage rollers 7, 9, and 10, and is ejected to the staple processing tray F by the staple ejecting roller 11. To introduce the sheet into the conveying path C, the solenoids of the bifurcating claw 15 and the bifurcating claw 16 are turned on in the state illustrated in FIG. 1. As a result, the free end of the bifurcating claw 15 is rotated upward by the predetermined amount, and the free end of the bifurcating claw 16 is rotated downward by the predetermined amount, thereby causing the conveying path A to communicate with the conveying path C. Thus, the sheet is conveyed along the conveying path C by a carriage roller 5, and is ejected to the shift tray T2 by ejecting rollers 6 composed of a pair of rollers 6*a* and 6*b*.

The sheet post-processing apparatus can perform various types of processing on the sheet. Examples of the various types of processing include punching (the punching device 100), sheet alignment and end binding (a jogger fence 53 and the end surface binding stapler S1), sheet alignment and center binding (the jogger fence 53 and a center-binding stapler S2), sheet sorting (the shift tray T2), and center folding (the folding plate 74 and folding rollers 81 and 82).

In the present embodiment, the image forming apparatus PR is an image forming apparatus using so-called electrophotography processing, such as a printer, a copying machine, a facsimile, and a digital multifunction peripheral (MFP) in which these functions are combined. The image forming apparatus PR performs optical writing on an image forming medium such as a photosensitive element based on received image data to form a latent image, and develops the latent image thus formed into a toner image, thereby forming a visible image. Because such an image forming apparatus using the electrophotography processing is widely known, detailed explanation and illustration of a configuration thereof will be omitted. In the present embodiment, the image forming apparatus using the electrophotography processing is explained as an example. Alternatively, the present embodiment may be applied to a system using a widely known image forming apparatus and a printing machine (printer), such as an ink-jet printer and a printing machine naturally.

2. Staple Processing Tray

The staple processing tray F is a tray on which the sheets are accumulated so as to perform sheet alignment and staple processing, and includes a mechanism for realizing these functions.

In the staple processing tray F that performs sheet alignment and staple processing, the sheet introduced into the staple processing tray F by the staple ejecting roller 11 is stacked on the tray surface 66 sequentially. In this case, a tapping roller 12 aligns each sheet in a longitudinal direction (sheet conveying direction), and the jogger fence 53 aligns each sheet in a lateral direction (sheet width direction orthogonal to the sheet conveying direction). Subsequently, at an interval between jobs, that is, between a last sheet of a sheet bundle and a leading sheet of a subsequent sheet bundle, a staple signal output from a central processing unit (CPU) 351 drives the end surface binding stapler S1 to perform binding. The sheet bundle thus bound is immediately conveyed to the ejecting rollers 6 by a releasing belt having a releasing claw 52*a*, and is ejected to the shift tray T2 set at a receiving position.

The home position of the releasing claw 52*a* is detected by a releasing belt home position sensor SN11. The releasing belt home position sensor SN11 is turned on or off by the releasing claw 52*a* provided to a releasing belt 52. On the outer periphery of the releasing belt 52, two releasing claws 52*a* are arranged at positions opposite to each other, and move or convey the sheet bundle housed in the staple processing tray F alternately.

Furthermore, on a driving shaft of the releasing belt 52 driven by a releasing motor, the releasing belt 52 and a driving pulley thereof are arranged at the center of alignment in the sheet width direction, and a releasing roller 56 is arranged and fixed symmetrically with respect thereto in the width direction. The peripheral speed of the releasing roller 56 is set higher than that of the releasing belt 52.

The tapping roller 12 is rotated about a fulcrum in a pendulum manner by a tapping solenoid, and intermittently taps the sheet fed into the staple processing tray F, thereby causing the sheet to abut on a trailing-edge fence 51. The tapping roller 12 rotates in a counterclockwise direction. The jogger fence 53 is driven by a jogger motor capable of rotating in normal and reverse directions via a timing belt, and reciprocates in the sheet width direction.

The end surface binding stapler S1 is driven by a stapler moving motor capable of rotating in normal and reverse directions, which is not illustrated, via a timing belt, and moves in the sheet width direction so as to bind a predetermined position at an end of the sheet. A stapler movement home position sensor that detects the home position of the end surface binding stapler S1 is provided to one end of the movement range. The binding position in the sheet width direction is controlled based on a movement amount of the end surface binding stapler S1 with respect to the home position.

Two center-binding staplers S2 are arranged so that the distance from the trailing-edge fence 51 to the stitching positions of the center-binding staplers S2 is equal to or longer than a distance corresponding to half the length in the conveying direction of the maximum sheet size capable of being center-bound. The two center-binding staplers S2 are arranged symmetrically with respect to the center of alignment in the sheet width direction, and are fixed to a stay, which is not illustrated. Furthermore, the center-binding stapler S2 includes a staple unit, and is composed of two separate units of a stitcher (driver) unit S23 that discharges a staple and a clincher unit S22 that bends the staple. The stitcher unit S23 is arranged on the conveying path D side of the staple processing tray F. The reference numeral SN10 in FIG. 1 denotes a sheet presence sensor that detects presence of a sheet on the staple processing tray F.

The sheet bundle on which center binding is performed in the staple processing tray F is folded at the center of the sheet. The center folding is performed in the center-folding tray G. Therefore, the sheet bundle thus bounded needs to be conveyed to the center-folding tray G. In the present embodiment, a sheet bundle deflecting mechanism is provided on the most downstream of the staple processing tray F in the conveying direction, and conveys the sheet bundle to the center-folding tray G.

The sheet bundle deflecting mechanism includes the bifurcating guide plate 54 and the movable guide 55. The bifurcating guide plate 54 is provided in a swingable manner in the vertical direction about a fulcrum. A pressing roller 57 is arranged in a rotatable manner on the downstream of the bifurcating guide plate 54, and the bifurcating guide plate 54 is pressed against the releasing roller 56 by a spring.

3. Center-Folding Tray

The folding plate 74 is caused to reciprocate in the horizontal direction in FIG. 1 by a mechanism and a motor, which are not illustrated. In other words, in FIG. 1, the folding plate 74 reciprocates in a direction perpendicular to a lower bundle conveying guide plate 91 and an upper bundle conveying guide plate 92. In the center-folding tray G, the lower edge of the sheet bundle conveyed by bundle carriage rollers 71 and 72 is stopped by a trailing-edge plate 73. The trailing-edge plate 73 is caused to move in the vertical direction by rotation of a pulley 322, thereby making it possible to adjust the height of the trailing edge of the sheet bundle. With this adjustment, it is possible to cause the center of the sheet bundle to face a tip portion of the folding plate 74.

The reference numerals SN2, SN3, SN4, SN5, SN21, SN23, and SN24 in FIG. 1 denote sensors that detect the conveying state of the sheet or the sheet bundle. The reference numeral SN30 is a sheet surface sensor that detects the upper surface of a sheet that is stacked on the shift tray T2 and returned by a returning roller 13.

4. Folding Apparatus

Figure 2:
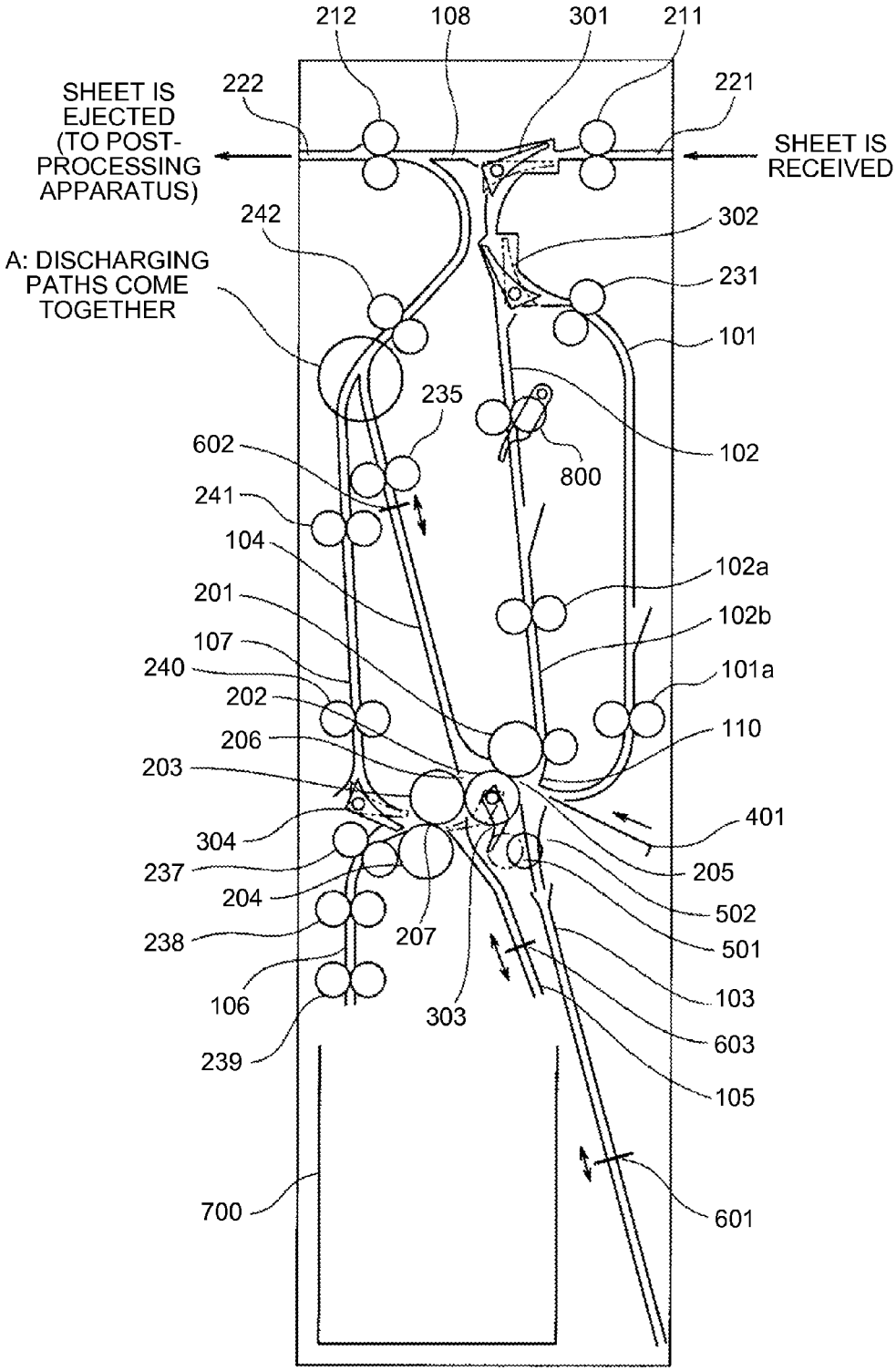
FIG. 2 is an enlarged view of a folding apparatus in FIG. 1.

FIG. 2 is an enlarged view of the folding apparatus ZF in FIG. 1. The folding apparatus ZF can perform various types of folding operations, such as half fold, offset z-fold, z-fold, tri-fold, double parallel fold, and double open gate-fold, and is attached to the side (subsequent stage) of the image forming apparatus PR. The folding apparatus ZF includes first to eighth conveying paths 101, 102, 103, 104, 105, 106, 107, and 108, and first to fourth folding rollers 201, 202, 203, and 204. The first to the fourth folding rollers 201 to 204 form first to third nips 205 to 207, and can perform the folding operations. The first nip 205 is formed between the first folding roller 201 and the second folding roller 202, the second nip 206 is formed between the second folding roller 202 and the third folding roller 203, and the third nip 207 is formed between the third folding roller 203 and the fourth folding roller 204. Because each of the first to the fourth folding rollers 201 to 204 forms the nip together with the roller adjacent thereto, the first to the fourth folding rollers 201 to 204 are configured to rotate synchronously.

The sheet ejected from the image forming apparatus PR is introduced by an entrance roller 211 in the folding apparatus ZF. The folding apparatus ZF includes the first conveying path 101 and the second conveying path 102 switched by a first switching claw 301 and a second switching claw 302 from an entrance 221 to an exit 222 via an ejecting roller 212. The first conveying path 101, the second conveying path 102, and the third conveying path 103 extend on the upstream (right side in FIG. 2) of the first nip 205 viewed from the entrance. The fourth conveying path 104 extends on the downstream (left side in FIG. 2) of the first nip 205. Furthermore, the fourth conveying path 104 extends on the upstream (upper side in FIG. 2) of the second nip 206 in the sheet conveying direction. The fifth conveying path 105 extends on the downstream (lower side in FIG. 2) of the second nip 206, and also extends on the upstream (right side in FIG. 2) of the third nip 207. The sixth conveying path 106 or the seventh conveying path 107 extends on the downstream (left side in FIG. 2) of the third nip 207.

The sixth conveying path 106 and the seventh conveying path 107 are selected by a fourth switching claw 304. If the sixth conveying path 106 is selected, the sheet is conveyed not to the ejecting roller 212, but to the lower part of the apparatus main body, and is ejected to a stacker 700 arranged at the lower part of the apparatus main body. By contrast, if the seventh conveying path 107 is selected, the sheet is conveyed through the seventh conveying path 107 that extends nearly vertically from the fourth switching claw 304 and joins the fourth conveying path 104 extending nearly linearly at an A position at the upper part, and is ejected from the exit 222 via the ejecting roller 212. The eighth conveying path 108 is a straight conveying path through which the sheet is conveyed directly from the entrance 221 to the exit 222 without passing through other conveying paths. The eighth conveying path 108 is formed by moving the first switching claw 301 in the clockwise direction in FIG. 2 to open the conveying path extending from the entrance 221 to the exit 222, and a sheet of unfolded paper is conveyed therethrough.

In the present embodiment, a third switching claw 303 and the fourth switching claw 304 are provided in addition to the first switching claw 301 and the second switching claw 302. The third switching claw 303 selects the conveying direction of the sheet on the downstream of the second nip 206, and the fourth switching claw 304 selects the conveying direction of the sheet on the downstream of the third nip 207. The third conveying path 103 extends downward nearly linearly, and a first stopper 601 is provided in a movable manner along the third conveying path 103. Similarly, a second stopper 602 and a third stopper 603 are provided in a movable manner along the fourth conveying path 104 and the fifth conveying path 105, respectively.

A folding plate 401 is arranged on the upstream of the first nip 205 in the sheet conveying direction, and can move forward and backward with respect to the nip 205. Furthermore, a fifth switching claw (not illustrated) that introduces the sheet passing through the first nip 205 into the second nip 206 is provided.

A guide 110 that curves along the roller surface of the first folding roller 201 is formed on the most downstream part of the second conveying path 102 in the sheet conveying direction. Furthermore, a tapping roller 501 and a jogger 502 that align the sheet when the sheet abuts on the first stopper 601 are provided. The tapping roller 501 aligns the leading edge of the sheet in the sheet conveying direction. By contrast, the jogger 502 aligns the sheet in a direction orthogonal to the sheet conveying direction, thereby aligning the sheet in the width direction. Furthermore, the stacker 700 is provided to the lower part of the apparatus main body. If the sixth conveying path 106 is selected, the sheet is guided to the stacker 700, and is dropped and accumulated in the stacker 700. The stacker 700 can be extracted by opening a door, which is not illustrated, on the front side of the apparatus main body as needed.

The first conveying path 101 has a carriage roller 231 and a first skew roller 101*a* from the upstream side. The second conveying path 102 has a moving roller unit 800 including a trailing edge holder and a second skew roller 102*a*. The fourth conveying path has a carriage roller 235. The sixth conveying path 106 has carriage rollers 237, 238, and 239. The seventh conveying path 107 has carriage rollers 240, 241, and 242. These rollers convey a sheet to be folded, a sheet being folded, and a folded sheet.

A path 102*b* on the downstream of the moving roller unit 800 in the sheet conveying direction in the second conveying path 102 and the third conveying path 103 on the downstream of the path 102*b* in the sheet conveying direction function as accumulation paths.

5. Punching Device

Figure 3:
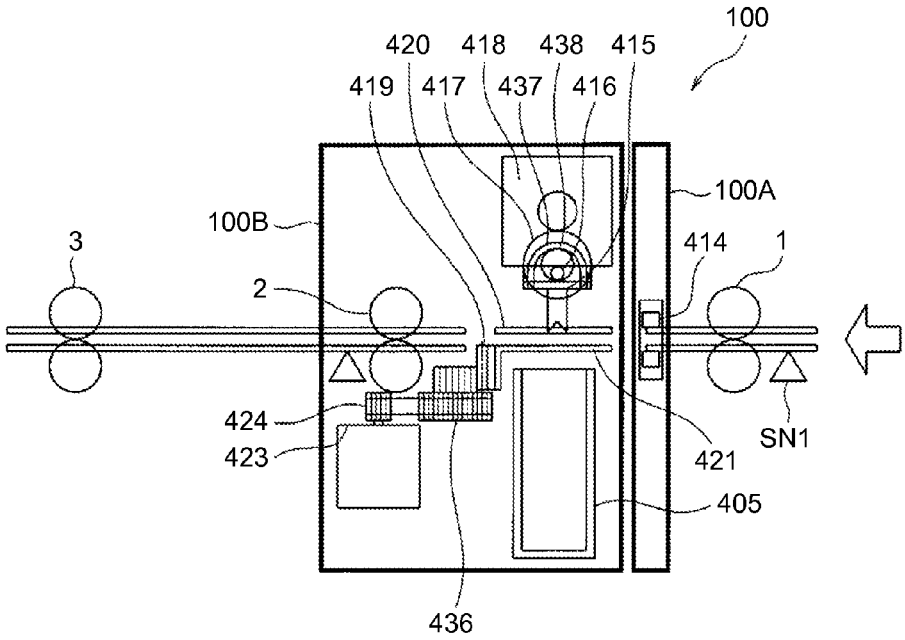
FIG. 3 is a schematic of a configuration of a punching device in FIG. 1 viewed from the front side of the device.
Figure 4:
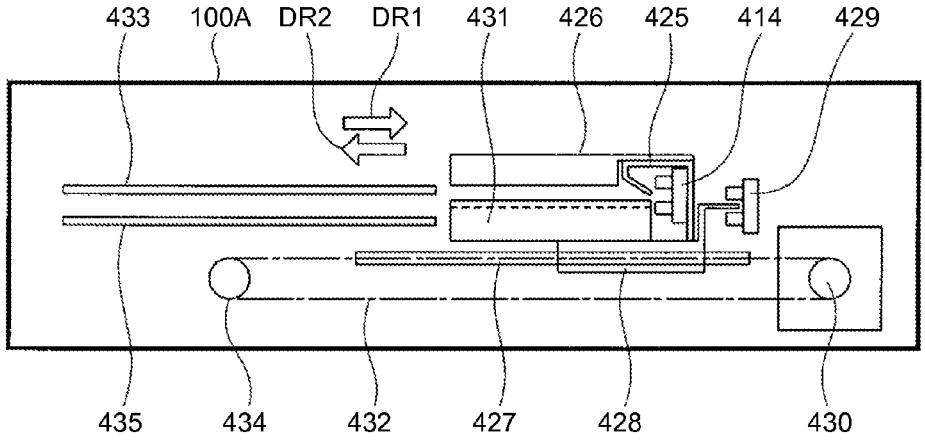
FIG. 4 is a side view of a lateral registration detection unit in FIG. 3.
Figure 5:
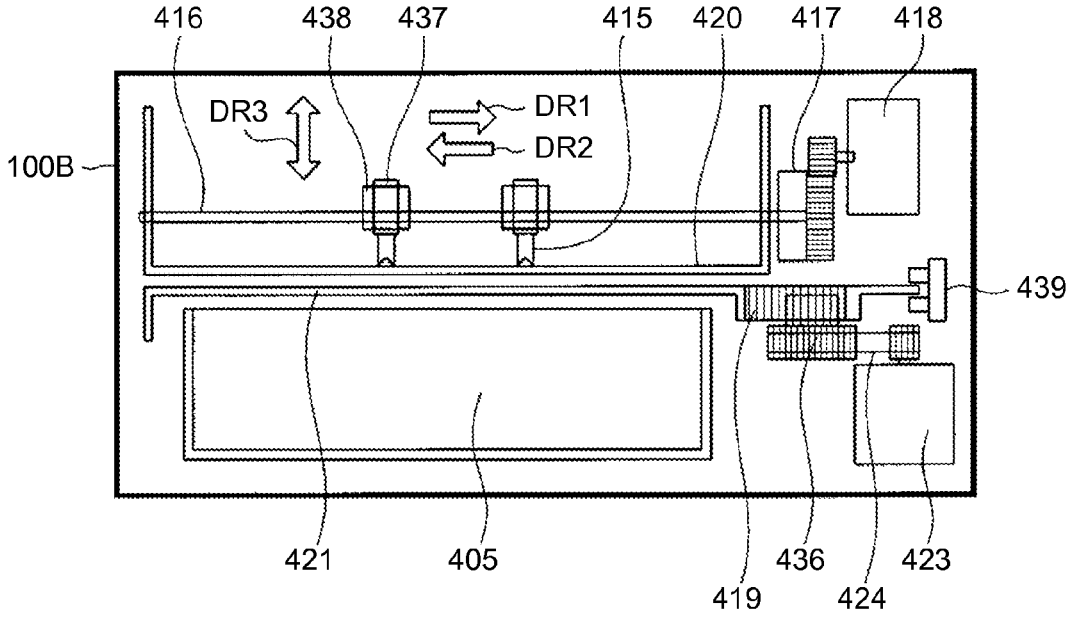
FIG. 5 is a side view of a punching unit in FIG. 3.

FIG. 3 is a schematic of a configuration of the punching device 100 in FIG. 1 viewed from the front side of the device. FIG. 4 is a side view of a lateral registration detection unit 100A. FIG. 5 is a side view of a punching unit 100B.

In FIG. 3, the punching device 100 includes a lateral registration detection unit 100A and a punching unit 100B. As illustrated in FIG. 4, the lateral registration detection unit 100A includes a sensor 414 (lateral registration detection sensor) that detects the position of an end parallel to the conveying direction of the sheet conveyed to the lateral registration detection unit 100A. The lateral registration detection sensor 414 can move in a direction (the arrow DR2 direction in FIG. 4) orthogonal to the conveying direction. The lateral registration detection sensor 414 is attached to a sheet guide 425, and the sheet guide 425 is attached to a holder 428.

The holder 428 moves in a direction (the arrow DR1 direction or the arrow DR2 direction) orthogonal to the conveying direction in a sliding manner along a shaft 427. The holder 428 is attached to a timing belt 432. The timing belt 432 is stretched across a first stepping motor 430 and a pulley 434. The timing belt 432 is rotated by rotary drive of the first stepping motor 430, thereby moving the holder 428, the sheet guide 425, and the lateral registration detection sensor 414.

The home position (standby position) of the lateral registration detection sensor 414 is determined by a sensor 429 detecting a part of the shape of the holder 428. From the standby position, the lateral registration detection sensor 414 is caused to move in the arrow DR2 direction to detect the end parallel to the conveying direction of the sheet along the shaft 427 via the series of components by drive of the first stepping motor 430.

As illustrated in FIG. 3 and FIG. 5, the punching unit 100B includes a punch blade 415, a holder 437, a cam 438, a clutch 417, a motor 418, a second stepping motor 423, a timing belt 424, a gear pulley 436, a rack 419, and a lower punch guide plate 421. The holder 437 is integrally provided to an upper end of the punch blade 415. The cam 438 is inserted into the holder 437, and is eccentrically attached to a shaft 416. The motor 418 drives the punch blade 415 via the clutch 417. The second stepping motor 423 causes the punch blade 415 to move in a direction orthogonal to the sheet conveying direction by means of the timing belt 424, the gear pulley 436, the rack 419, and the lower punch guide plate 421.

Figure 6:
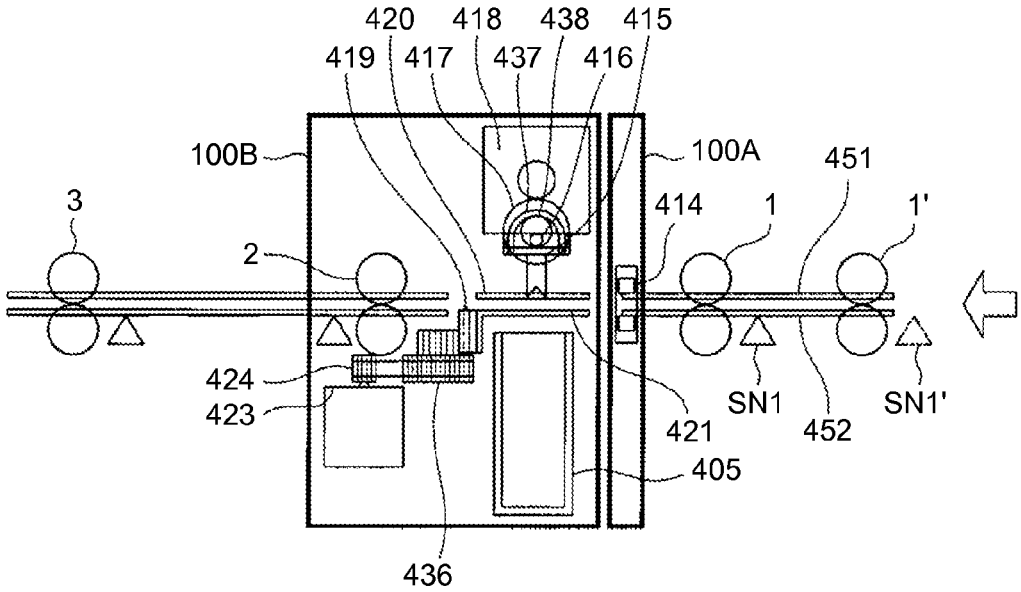
FIG. 6 is a schematic of a configuration of another punching device further provided with a pair of carriage rollers at a stage prior to entrance rollers in FIG. 3.

FIG. 6 illustrates an example in which another pair of carriage rollers (hereinafter, simply referred to as a carriage roller) 1' is provided at a stage prior to the entrance roller 1 in FIG. 3, and the carriage roller 1' is driven independently of the entrance roller 1. In this case, as will be described later, the entrance sensor SN1 can be provided on the upstream of the carriage roller 1'. In FIG. 6, the entrance sensor provided on the upstream of the carriage roller 1' is represented by a reference numeral SN1'.

To perform punching by the punching unit 100B composed of the units described above, the punching operation is performed as follows.

Drive of the motor 418 causes the punch blade 415 of the punching unit 100B to move vertically, that is, to punch the sheet. At this time, the motor 418 causes the shaft 416 to rotate one revolution via the clutch 417. The clutch 417 is turned on after a certain period of time elapses since the trailing edge of the sheet thus conveyed passes by the entrance sensor SN1. When the shaft 416 rotates, the cam 438 eccentrically attached to the shaft 416 also rotates, thereby causing the holder 437 to move vertically (the arrow DR3 direction in FIG. 5). The vertical movement of the holder 437 causes the punch blade 415 to move vertically and to bore a punch hole in the sheet during the downward movement.

In the present embodiment, an explanation is made of the punching unit 100B that employs a press punching method in which conveyance of the sheet is stopped temporarily to bore a punch hole. Alternatively, it may be applied to a rotary punch that includes rotating bodies each provided with a punch blade and a die, and that bores a punch hole by fitting the punch blade into the die by the rotation while conveying a sheet.

To perform punching in this manner, it is necessary to perform positioning of the punching unit 100B by moving the punching unit 100B in directions (the arrow DR1 and arrow DR2 directions in FIG. 5) orthogonal to the sheet conveying direction depending on the deviation described above. The punching unit 100B is moved by using the second stepping motor 423 as a driving source. The second stepping motor 423 transmits the driving force from a driving pulley thereof to the gear pulley 436 via the timing belt 424, thereby rotating the gear pulley 436. Because the rack 419 engages with the gear of the gear pulley 436, the rotation of the gear pulley 436 causes the rack 419 to move in the arrow DR1 and the arrow DR2 directions in FIG. 5.

The rack 419 is attached to the lower punch guide plate 421, and all elements for performing punching (hereinafter, referred to as punching elements), such as the punch blade 415, an upper punch guide 420, the shaft 416, the cam 438, the holder 437, the clutch 417, and the motor 418, are connected to the lower punch guide plate 421. Therefore, the movement of the rack 419 causes all the punching elements to move in the direction orthogonal to the sheet conveying direction. At a position below the lower punch guide plate 421 and vertically below the punch blade 415, a punch waste hopper 405 is provided in an attachable manner and a detachable manner by extracting the punch waste hopper 405 outside the device. In FIG. 5, a reference numeral 439 denotes a home position sensor that detects the home position of the punching unit 100B in the sheet width direction.

The movement amount of the lateral registration detection sensor 414 per one pulse of the first stepping motor 430 is assumed to be a. In this case, if no lateral registration deviation occurs in the sheet being conveyed, and the sheet is conveyed to an ideal position, for example, a movement amount w of the sensor 414 from the standby position to a position at which the sensor 414 detects the end parallel to the conveying direction of the sheet is assumed to be 10*a*. Practically, if the movement amount of the sensor 414 to the position at which the sensor 414 detects the end parallel to the conveying direction of the sheet thus conveyed is 11*a*, lateral registration deviation Δd of a distance calculated by Equation (1) occurs:

$$11a-10a=1a \tag{1}$$

At this time, the movement amount of the punching elements per one pulse of the second stepping motor 423 is assumed to be b. If the relationship between the movement amount a of the lateral registration detection sensor 414 per one pulse of the first stepping motor 430 in the lateral registration detection unit 100A and the movement amount b is approximately an integral multiple (e.g., double), the relationship is calculated by Equation (2):

$$a=2\times b \tag{2}$$

If lateral registration deviation occurs in the sheet by 1*a* as calculated by Equation (1), because the movement distance of the lateral registration detection sensor 414 per one pulse is a, lateral registration deviation per one pulse occurs. Therefore, to move the punching elements, it is necessary to input pulses for a distance of 1*a* to the second stepping motor 423. Because the relationship of the movement distances per one pulse is a relationship calculated by Equation (2), the number of pulses to be input to the second stepping motor 423 is twice as many as the number of pulses of a deviation amount calculated based on the detection output of the lateral registration detection sensor 414.

In other words, end position information supplied from the lateral registration detection sensor 414 is recognized as pulses. Subsequently, a CPU 381 of a control device 380 of the sheet post-processing apparatus FR compares the end position information with sheet width size information, and calculates the deviation amount of lateral registration in the sheet. The calculation result is then input to the second stepping motor 423 as pulses, thereby moving the punching elements. At this time, the number of pulses to be input to the second stepping motor 423 is calculated by Equation (2). As a result, an error occurring when the elements are moved by pulses decreases, and the punching position accuracy is improved. Furthermore, because the number of pulses to be input to the second stepping motor 423 that moves the punching elements constantly regardless of the deviation amount is calculated by Equation (2), software control can be facilitated.

In the present embodiment, the lateral registration detection sensor 414 illustrated in FIG. 4 moves in the arrow DR2 direction in FIG. 4 to detect the end of the sheet parallel to the sheet conveying direction. Subsequently, the punching elements moves in the arrow DR2 direction in FIG. 5 based on the detection information to perform punching. Before the movement of the punching elements, the lateral registration detection sensor 414 returns to the standby position. In other words, after detecting the end of the sheet, the lateral registration detection sensor 414 needs to return to the standby position (in the arrow DR1 direction in FIG. 5) so as to detect a difference in an end of a subsequent sheet. Therefore, the more promptly the lateral registration detection sensor 414 returns, the more smoothly the lateral registration detection sensor 414 responds to a high-productive image forming apparatus.

The standby position of the lateral registration detection sensor 414 needs to be a position not to prevent conveyance of a sheet. From the position, the lateral registration detection sensor 414 starts to move in the arrow DR2 direction in FIG. 4 so as to read the end of the sheet being conveyed. To deal with various width sizes including the length and the width of the sheet, the lateral registration detection sensor 414 needs to move along a guiding member to read the end position of the sheet. Generally, if a fixed guiding member is present in a movable range of the lateral registration detection sensor 414, the guiding member serves as an obstacle in the way of the lateral registration detection sensor 414. To address this, in the present embodiment, an upper guide 426 and a lower guide plate 431 are moved integrally in a manner attached to the lateral registration detection sensor 414. With this configuration, the guiding member can move the lateral registration detection sensor 414 that detects the end parallel to the conveying direction while also serving as a sheet guide to stabilize the conveyance performance.

Furthermore, the upper guide 426 and the lower guide plate 431 that move in association with movement of the lateral registration detection sensor 414 in the arrow DR2 direction in FIG. 4 constitute the sheet guide by overlapping with a fixed upper guide 433 and a fixed lower guide 435, respectively.

6. Skew Correction Device

The sheet on which an image is formed by the image forming apparatus PR passes through the folding apparatus ZF, and is conveyed to the punching device 100 of the sheet post-processing apparatus FR. At this time, it is likely that skew occurs in the sheet, and the punching position accuracy fails to be improved without correcting for the skew. Therefore, when punching is performed on the sheet, by causing the leading edge of the sheet to abut on a nip between rollers, the skew is corrected.

The present embodiment employs two types of skew correction in which a sheet is caused to abut on stopped registration rollers (normal skew correction: first skew correction) and skew correction in which a sheet is caused to abut on the stopped registration rollers, and thereafter the registration rollers are rotated reversely (reverse-rotation skew correction). FIGS. 7A and 7B and FIGS. 8A and 8B are schematics for explaining normal skew correction in a sheet of unfolded paper (hereinafter, referred to as normal paper) P other than a sheet of offset z-fold paper (hereinafter, referred to as z-fold paper). In the present embodiment, the entrance roller 1 illustrated in FIG. 6 functions as a pair of registration rollers, and the entrance sensor SN1 is arranged on the upstream of the carriage roller 1'. The carriage roller 1' may be referred to as a first conveying unit, and the entrance roller 1 functioning as a registration roller may be referred to as a second conveying unit.

Figure 7A:
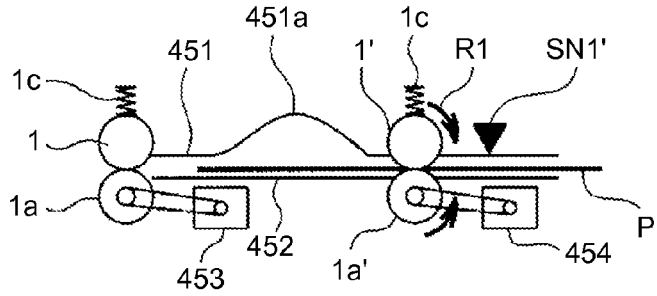
FIGS. 7A and 7B are schematics for explaining normal skew correction in the embodiment of the present invention, and illustrate a state in which normal paper enters.
Figure 7B:
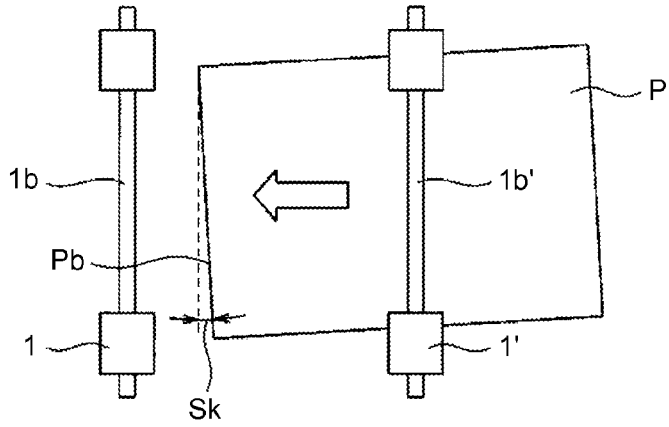
Figure 8A:
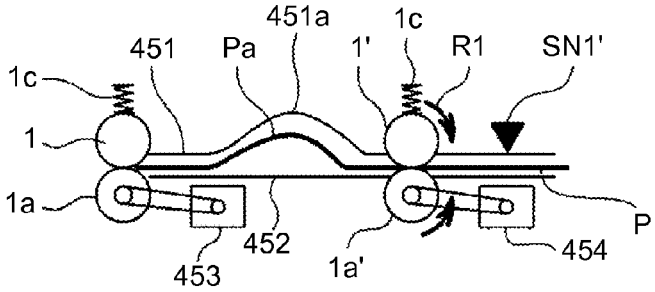
FIGS. 8A and 8B are schematics for explaining the normal skew correction in the embodiment of the present invention, and illustrate a state in which skew of the normal paper is being corrected.
Figure 8B:
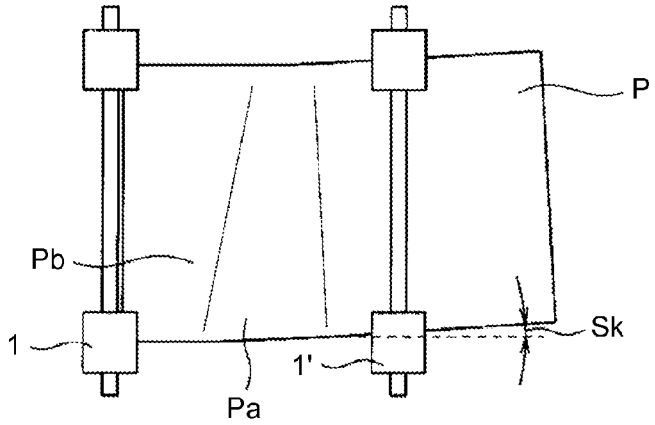

FIG. 7A and FIG. 8A are front views, and FIG. 7B and FIG. 8B are plane views. In FIG. 7A and FIG. 8A, the entrance roller 1 and the carriage roller 1' are arranged such that nips are formed in a conveying path formed by an upper conveyance guiding plate 451 and a lower conveyance guiding plate 452, and each driving roller of the pairs of rollers 1 and 1' is driven independently. In other words, a driving roller 1*a* of the pair of rollers 1 and a driving roller 1*a'* of the pair of rollers 1' are driven by motors 453 and 454 via driving mechanisms, respectively. Furthermore, driven rollers are biased by springs 1*c*, whereby the sheet can be nipped between the driving rollers and the driven rollers reliably. In the present embodiment, the entrance roller 1 and the carriage roller 1' are provided in pair to both ends of a shaft 1*b* and a shaft 1*b'*, respectively.

A bulging portion (convex portion) 451*a* is provided to the upper conveyance guiding plate 451 as a buffer used when the leading edge of the normal paper P abuts on the nip of the entrance roller 1 and to form flexure. The capacity of the bulging portion 451*a* is set to a capacity that can absorb the maximum flexure amount of the sheet in the maximum size to be conveyed.

In FIGS. 7A and 7B and FIGS. 8A and 8B, the normal paper P transmitted from the folding apparatus ZF on the upstream side passes by the entrance sensor SN1', and is conveyed by the carriage roller 1' (in the arrow R1 direction). The normal paper P thus conveyed abuts on the entrance roller 1 that is stopped. After the entrance sensor SN1' detects the leading edge Pb of the normal paper P, the carriage roller 1' rotates by a certain amount and stops. At this time, the normal paper P is further conveyed with the leading edge Pb of the normal paper P abutting on the nip of the entrance roller 1. As a result, flexure Pa is formed in the normal paper P as illustrated in FIGS. 8A and 8B. At this time, the flexure Pa allows the leading edge Pb of the normal paper P to abut on the nips of the entrance rollers 1 evenly on both sides corresponding respectively to the nips. If the entrance roller 1 and the carriage roller 1' are rotated normally (rotated in the conveying direction) in this state, skew Sk of the normal paper P illustrated in FIG. 8B is corrected. This operation is the same as that in the conventional method. Angles or deviation amounts in skew indicated by arrows in FIGS. 7A and 7B and FIGS. 8A and 8B is the skew amount.

Figure 9A:
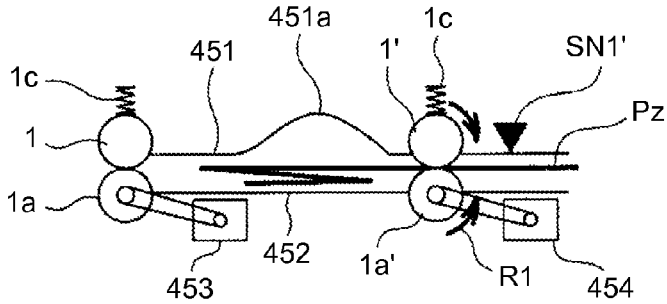
FIGS. 9A and 9B are schematics for explaining reverse-rotation skew correction in the embodiment of the present invention, and illustrate a state in which z-fold paper enters.
Figure 9B:
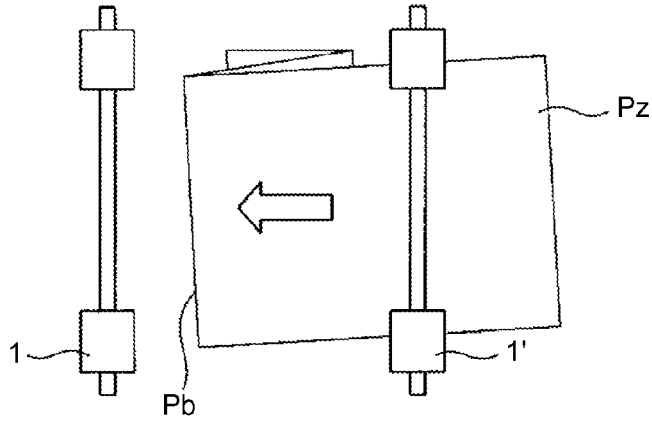
Figure 10A:
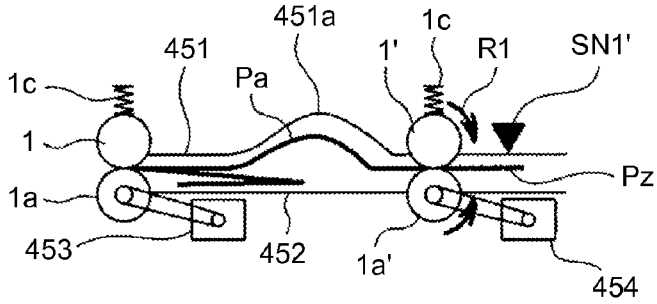
FIGS. 10A and 10B are schematics for explaining the reverse-rotation skew correction in the embodiment of the present invention, and illustrate a state in which the leading edge of the z-fold paper is abutting on the entrance rollers unevenly.
Figure 10B:
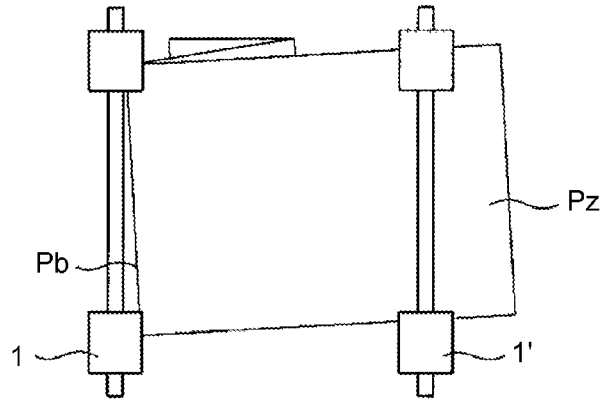

FIGS. 9A and 9B and FIGS. 10A and 10B are schematics for explaining reverse-rotation skew correction for a sheet on which z-fold processing is performed. FIG. 9A and FIG. 10A are front views, and FIG. 9B and FIG. 10B are plane views. As illustrated in FIGS. 9A and 9B, an assumption is made that skew occurs when a sheet on which z-fold processing is performed (z-fold paper) Pz is conveyed. If skew occurs in this manner, as illustrated in FIG. 10B, the leading edge Pb of the z-fold paper Pz fails to enter the nips of the entrance rollers 1 on the both sides evenly as illustrated in FIG. 8B. As a result, even if flexure Pa is formed similarly to the normal paper P on which no z-fold processing is performed, the skew fails to be corrected properly. This is because the leading edge of the z-fold paper Pz in the conveying direction is a fold line. More specifically, this may be because one side of the z-fold paper Pz alone is nipped between first rollers (on the upper side in FIG. 10B), and the other side (on the lower side) fails to enter the nip between second rollers because of bulge at the folded portion, buckling occurring when the leading edge abuts, and other factors. In addition, frictional force generated by the bulge at the folded portion between the lower guiding plate 452 and the folded sheet portion may function as resistance when the position is corrected and as an obstacle to skew correction.

Figure 11A:
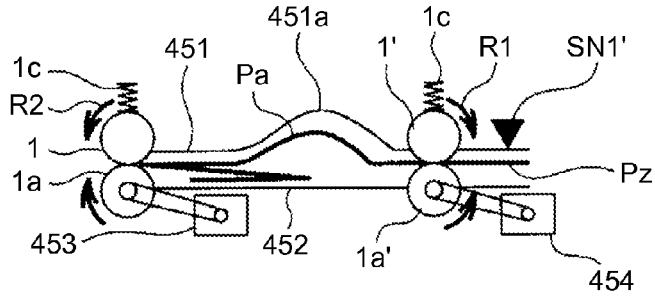
FIGS. 11A and 11B are schematics for explaining the reverse-rotation skew correction in the embodiment of the present invention, and illustrate a state in which the skew correction of the z-fold paper starts.

This indicates that the skew in the z-fold paper Pz fails to be corrected by the normal skew correction illustrated in FIGS. 7A and 7B and FIGS. 8A and 8B. Therefore, in the present embodiment, after the operations illustrated in FIGS. 9A and 9B and FIGS. 10A and 10B, an operation illustrated in FIGS. 11A and 11B is performed by conveyance control, thereby correcting the skew in the z-fold paper Pz.

In other words, if the normal skew correction is performed on the z-fold paper Pz, the leading edge Pb of the sheet fails to enter the nip of the entrance roller 1 functioning as a registration roller properly as illustrated in FIG. 10B, whereby the skew is not corrected. To address this, the carriage roller 1' conveys the z-fold paper Pz until flexure is formed in the z-fold paper Pz abutting on the nip of the entrance roller 1 that is stopped, and the carriage roller 1' is stopped temporarily. This process is illustrated in FIGS. 9A and 9B and FIGS. 10A and 10B, and the flexure is formed as illustrated in FIG. 10A. Subsequently, as illustrated in FIG. 11A, the entrance roller 1 is rotated reversely (in arrow R2 directions) for a predetermined period of time.

Figure 11B:
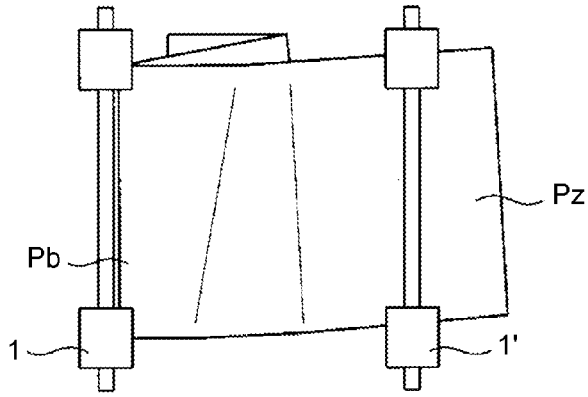

With this operation, the sheet nipped between the first rollers positioned on the one side in FIG. 11B is pushed back in a state being subjected to force by the flexure Pa. At the same time, the leading edge Pb not being nipped between the second rollers positioned on the other side is caused to go forward by restoring force of the flexure Pa. As a result, the leading edge Pb of the z-fold paper Pz on both sides abuts on the vicinity of the nip of the entrance roller 1 at the same position. In other words, the leading edge Pb of the z-fold paper Pz on both sides abuts on the entrance roller 1 evenly. Subsequently, the entrance roller 1 and the carriage roller 1' are rotated simultaneously to convey the z-fold paper Pz again. As a result, the skew in the z-fold paper Pz is corrected.

The example illustrated in FIGS. 9A and 9B and FIGS. 11A and 11B, the leading edge Pb of the z-fold paper Pz is caused to abut on the entrance roller 1 that is stopped, and the entrance roller 1 is temporarily rotated in reverse directions (arrow R2 directions) to the conveying direction for a predetermined period of time. By contrast, even if the entrance roller 1 is rotated reversely in advance before the z-fold paper Pz abuts on the entrance roller 1, it is possible to correct the skew in the z-fold paper Pz.

Figure 12A:
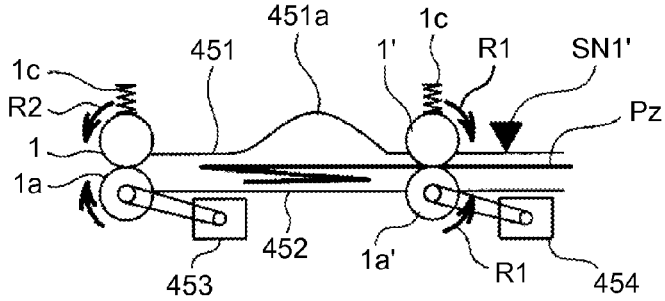
FIGS. 12A and 12B are schematics for explaining the reverse-rotation skew correction in the embodiment of the present invention, and illustrate a state in which the carriage rollers rotate normally to convey the z-fold paper after the skew correction.
Figure 12B:
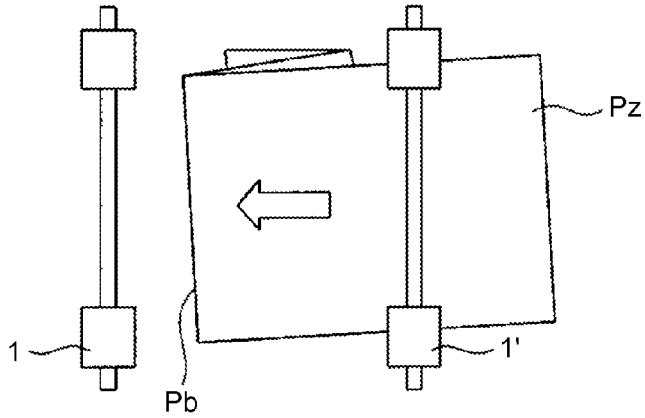
Figure 13A:
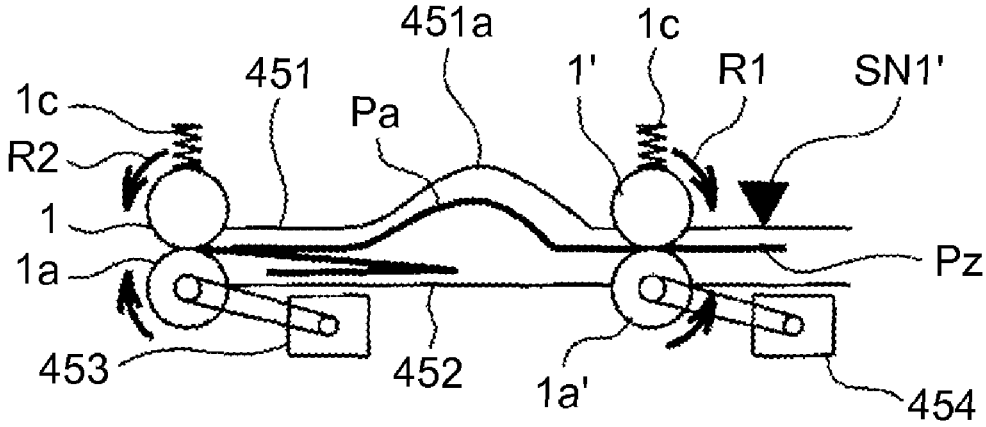
FIGS. 13A and 13B are schematics for explaining the reverse-rotation skew correction in the embodiment of the present invention, and illustrate a state in which the leading edge of the z-fold paper is caused to abut on the entrance rollers rotating reversely.
Figure 13B:
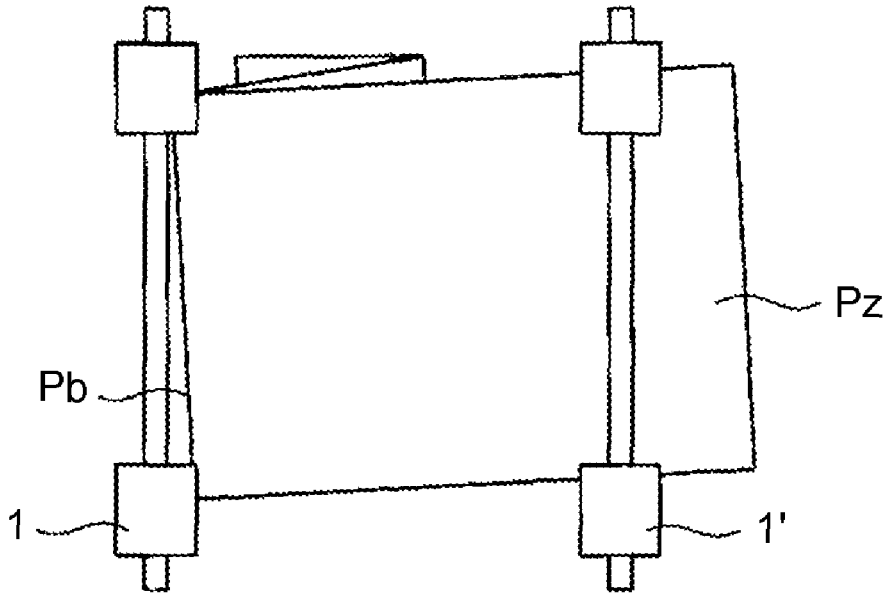

Before the z-fold paper Pz is conveyed by the carriage roller 1', and the leading edge Pb thereof reaches the entrance roller 1, for example, the reverse operation of the entrance roller 1 is started as illustrated in FIG. 12A. As a result, when the leading edge Pb of the z-fold paper Pz abuts on the nip of the entrance roller 1 on the one side or on the vicinity of the nip as illustrated in FIGS. 13A and 13B, for example, the entrance roller 1 has already been rotated reversely (rotated in the arrow R2 directions). Therefore, the entrance roller 1 on the one side applies force in an opposite direction to the conveying direction to the leading edge Pb abutting thereon.

During this time, the leading edge Pb of the z-fold paper Pz facing the entrance roller 1 on the other side is caused to go forward in the conveying direction by restoring force of the flexure Pa in the sheet. As a result, the leading edge Pb abuts on the entrance rollers 1 on the one side and the other side evenly as illustrated in FIG. 11B. After the leading edge Pb abuts on the entrance roller 1 in this manner, the carriage roller 1' and the entrance roller 1 are caused to stop driving. After the entrance roller 1 stops, the entrance roller 1 restarts driving in the conveying direction together with the carriage roller 1', thereby conveying the z-fold paper Pz. Thus, the skew in the z-fold paper Pz is corrected.

7. Control Configuration

Figure 14:
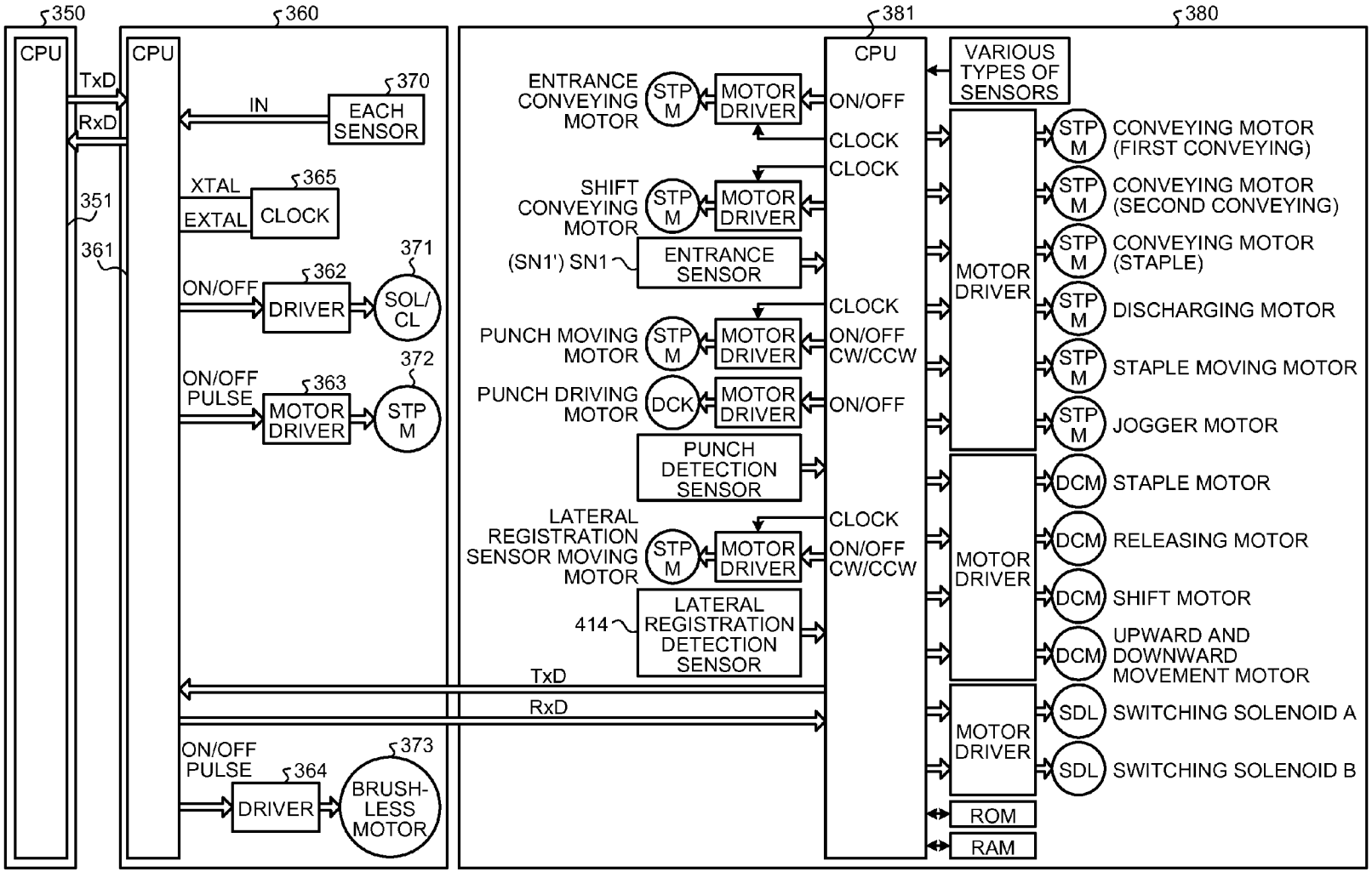
FIG. 14 is a block diagram of a schematic control configuration of the image forming system according to the embodiment of the present invention.

FIG. 14 is a block diagram of a schematic control configuration of the image forming system according to the present embodiment. In FIG. 14, a control device 360 of the folding apparatus ZF transmits and receives a signal to and from a control device 350 of the image forming apparatus PR, and is configured centering on a CPU 361 that controls each unit. The CPU 361 includes a random access memory (RAM) serving as a work area of the CPU 361, a read-only memory (ROM) that stores therein various types of control and data, drivers that drive various types of motors arranged in the apparatus, and various types of sensors.

Specifically, the CPU 361 drives a solenoid and clutch 371, a stepping motor 372, a brushless motor 373, and the like in response to input from each sensor 370 as illustrated in FIG. 14. Therefore, the control device 360 includes a first driver 362 that drives the solenoid and clutch 371, a motor driver 363 that drives the stepping motor 372, and a second driver 364 the drives the brushless motor 373. The control device 360 further includes a clock generating unit (oscillator) 365 that supplies a clock to the CPU 361. While the sensor 370, the solenoid and clutch 371, the stepping motor 372, and the brushless motor 373 are provided to units to be operated, respectively, each one of them is illustrated as a representative in FIG. 14.

The CPU 361 of the control device 360 of the folding apparatus ZF transmits and receives a control signal to and from a CPU 351 of the control device 350 of the image forming apparatus PR, and also transmits and receives a control signal to and from the CPU 381 of a control device 300 of the sheet post-processing apparatus FR. In FIG. 14, the control device 360 of the folding apparatus ZF is connected to the control device 350 of the image forming apparatus PR. The image forming apparatus PR in this case is a copying machine or an MFP. If the image forming apparatus PR is a printer, a signal is also transmitted and received to and from a host device.

The control device 380 of the sheet post-processing apparatus FR is configured centering on the CPU 381. The CPU 381 includes a RAM serving as a work area of the CPU 381, a ROM that stores therein various types of control and data, drivers that drive various types of motors arranged in the apparatus, and various types of sensors. Specifically, the CPU 381 outputs a control signal to motor drivers via an input-output (I/O) interface (not illustrated), thereby controlling various types of motors. Examples of various types of motors include an entrance conveying motor 453 that drives the entrance roller 1, the conveying motor 454 that drives the carriage roller 1', a conveying motor that drives carriage rollers provided to each conveying path and each processing unit, a discharging motor that drives the ejecting rollers 6, the stapler moving motor that moves a staple device, a jogger motor that moves the jogger fence, and a stepping motor, such as a punch moving motor (second stepping motor 423) that moves the punch blade 415, and a lateral registration sensor moving motor (first stepping motor 430) that moves the lateral registration detection sensor 414. Similarly, the CPU 381 controls motors other than the stepping motors, such as an upward and downward movement motor of the shift tray, a shift motor, a staple motor that drives the staple device, a releasing motor that drives the releasing belt, and a punch driving motor (motor 418) that drives the punch blade 415 in the vertical direction so as to bore a punch hole in the sheet. Furthermore, the CPU 381 controls a switching solenoid that drives each bifurcating claw for switching conveying paths through which the sheet is conveyed.

The image forming apparatus PR, the folding apparatus ZF, and the sheet post-processing apparatus FR are connected to one another via a serial interface, and transmit and receive required control data through serial communications. When receiving a signal indicating that a user selects a "z-fold processing mode" from the image forming apparatus PR, the folding apparatus ZF performs sheet folding on the normal paper P conveyed from the image forming apparatus PR. Thus, the folding apparatus ZF forms the z-fold paper Pz whose front end in the conveying direction is folded in a z-shape as illustrated in FIGS. 9A and 9B to FIGS. 11A and 11B, and conveys the z-fold paper Pz to the sheet post-processing apparatus FR. By receiving the signal indicating that the "z-fold processing mode" is selected, the CPU 381 of the sheet post-processing apparatus FR detects that the z-fold paper Pz is to be conveyed. Thus, the CPU 381 performs control illustrated in FIGS. 10A and 10B and FIGS. 11A and 11B, thereby performing skew correction. Therefore, the CPU 381 of the sheet post-processing apparatus FR may be referred to as a determination unit.

The program data executed by the CPUs 351, 361, and 381 may be available by being downloaded or being upgraded to a storage medium such as a hard disk drive (HDD), which is not illustrated, from a server via a network or from a recording medium, such as a compact disk read-only memory (CD-ROM) and a Secure Digital (SD) card, via a recording medium driving device instead of or in addition to the ROM, which is not illustrated, provided to the control devices 350, 360, and 380.

8. Skew Correction Control

Figure 15:
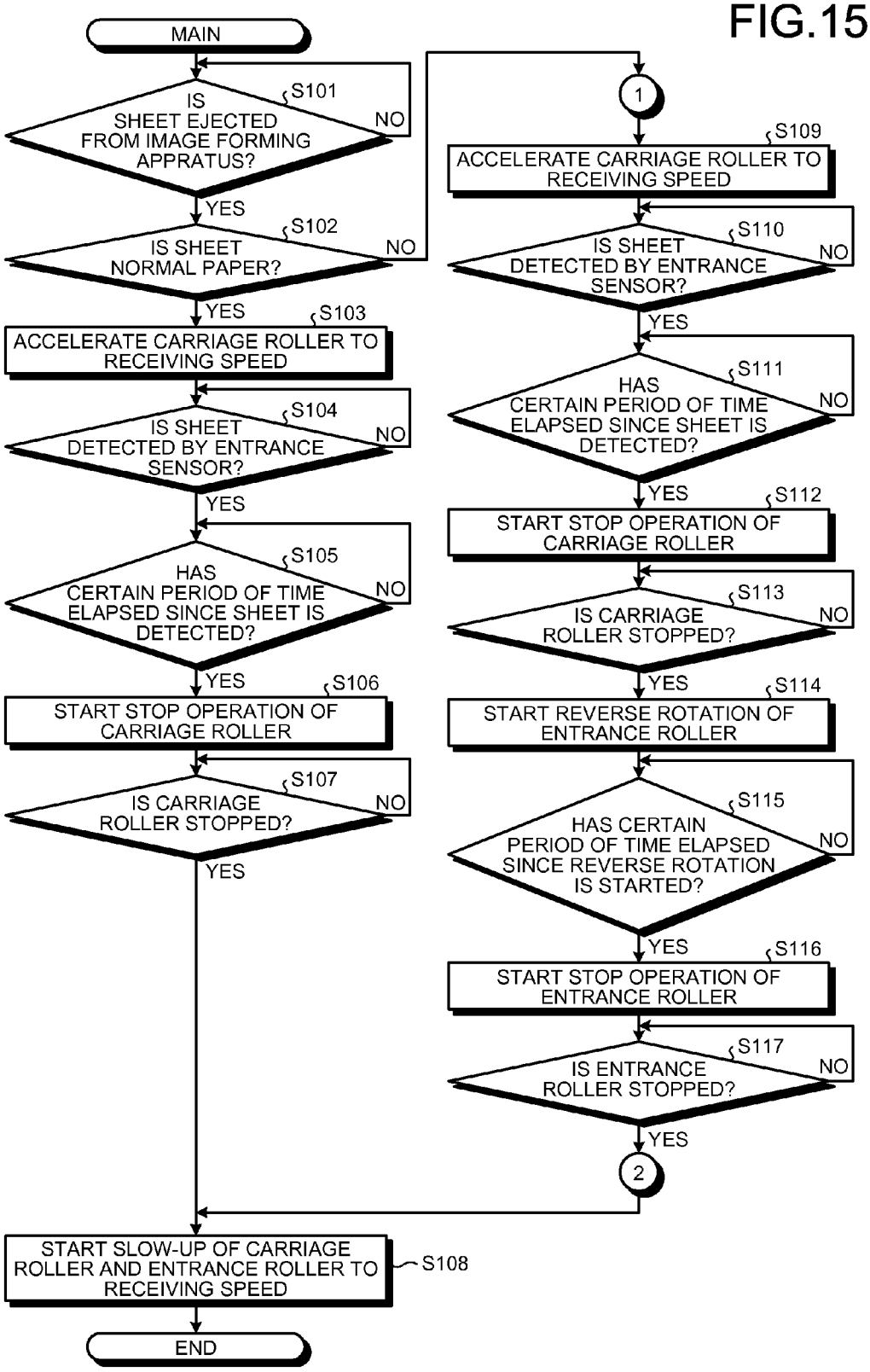
FIG. 15 is a flowchart illustrating a process of skew correction in the control configuration in FIG. 14.

FIG. 15 is a flowchart illustrating a process of skew correction performed by the CPU 381 of the sheet post-processing apparatus FR. The process is an exemplary process performed when one sheet bundle includes the z-fold paper Pz and the normal paper P. In FIG. 15, if the image forming apparatus PR ejects a sheet (Yes at Step S101), it is determined whether the sheet to be conveyed is the normal paper P or the z-fold paper Pz. This determination is performed based on fold-type information transmitted from the CPU 351 of the image forming apparatus PR to the CPU 381 of the sheet post-processing apparatus FR via the CPU 361 of the folding apparatus ZF. In the initial state, the carriage roller 1' and the entrance roller 1 are stopped. After the control is started, driving of the carriage roller 1' and the entrance roller 1 is controlled based on the control signal from the CPU 381.

If it is determined that the sheet conveyed from the image forming apparatus PR is the normal paper P (Yes at Step S102), the carriage roller 1' is accelerated to sheet receiving speed (slow up) (Step S103). If the entrance sensor SN1' detects the leading edge of the sheet (Yes at Step S104), the normal paper P is simply conveyed for a certain period of time (refer to FIGS. 7A and 7B). If the normal paper P thus conveyed abuts on the nip of the entrance roller 1 that is stopped, and a certain period of time elapses (Yes at Step S105), that is, if the normal paper P is conveyed by a certain amount, a stop operation of the carriage roller 1' is started (Step S106). With this operation, the flexure Pa is formed in the normal paper P, and the leading edge Pb is caused to abut on the entrance rollers 1 on the one side and the other side evenly by the restoring force of the flexure Pa (refer to FIG. 8B).

If it is confirmed that the carriage roller 1' stops (Yes at Step S107), rotation of the entrance roller 1 and the carriage roller 1' is started, and both the rollers are accelerated to receiving speed for the normal paper P simultaneously (slow up), thereby conveying the normal paper P (Step S108). As a result, the skew of the normal paper P is corrected as illustrated in FIGS. 8A and 8B.

By contrast, the image forming apparatus PR notifies that the sheet is the z-fold paper Pz, and the CPU 381 determines that the sheet is not the normal paper P at Step S102 (No at Step S102), the CPU 381 performs skew correction on the z-fold paper Pz. In the skew correction on the z-fold paper Pz, the carriage roller 1' is accelerated to the sheet receiving speed (slow up) (Step S109). After the entrance sensor SN1' detects the leading edge Pb of the z-fold paper Pz (Yes at Step S110), the z-fold paper Pz is simply conveyed for a certain period of time (refer to FIGS. 9A and 9B). If the z-fold paper Pz thus conveyed abuts on the nip of the entrance roller 1 that is stopped, and if a certain period of time long enough to form required flexure elapses (Yes at Step S111), that is, if the z-fold paper Pz is conveyed by a certain amount enough to form the flexure, a stop operation of the carriage roller 1' is started (Step S112). With this operation, while the flexure Pa is formed in the normal paper P, the skew is not corrected (refer to FIGS. 10A and 10B). Therefore, if it is confirmed that the carriage roller 1' stops (Yes at Step S113), reverse rotation of the entrance roller 1 is started (Step S114).

If the reverse rotation continues for a certain period of time (Step S115), the one side of the z-fold paper Pz maintains the state not being nipped but abutting on the entrance roller 1 on the one side as explained with reference to FIGS. 11A and 11B. During this time, the other side of the z-fold paper Pz is caused to move toward the entrance roller 1 on the other side by restoring force of the flexure Pa. As a result, the leading edge Pb of the z-fold paper Pz abuts on the entrance rollers 1 on the one side and the other side evenly. If a certain period of time long enough to cause the leading edge Pb to abut on the entrance roller 1 evenly elapses (Yes at Step S115), a stop operation of the reverse rotation of the entrance roller 1 is started (Step S116). If the entrance roller 1 stops (Yes at Step S117), rotation of the carriage roller 1' and the entrance roller 1 is started, and both the rollers are accelerated to receiving speed for the z-fold paper Pz (slow up), thereby conveying the z-fold paper Pz (Step S108). Thus, the z-fold paper Pz is conveyed from the state illustrated in FIGS. 11A and 11B, whereby the skew of the z-fold paper Pz is corrected.

With the control described above, even if one sheet bundle includes the normal paper P and the z-fold paper Pz, it is possible to deal with both the sheets by changing the methods for controlling skew.

Figure 16:
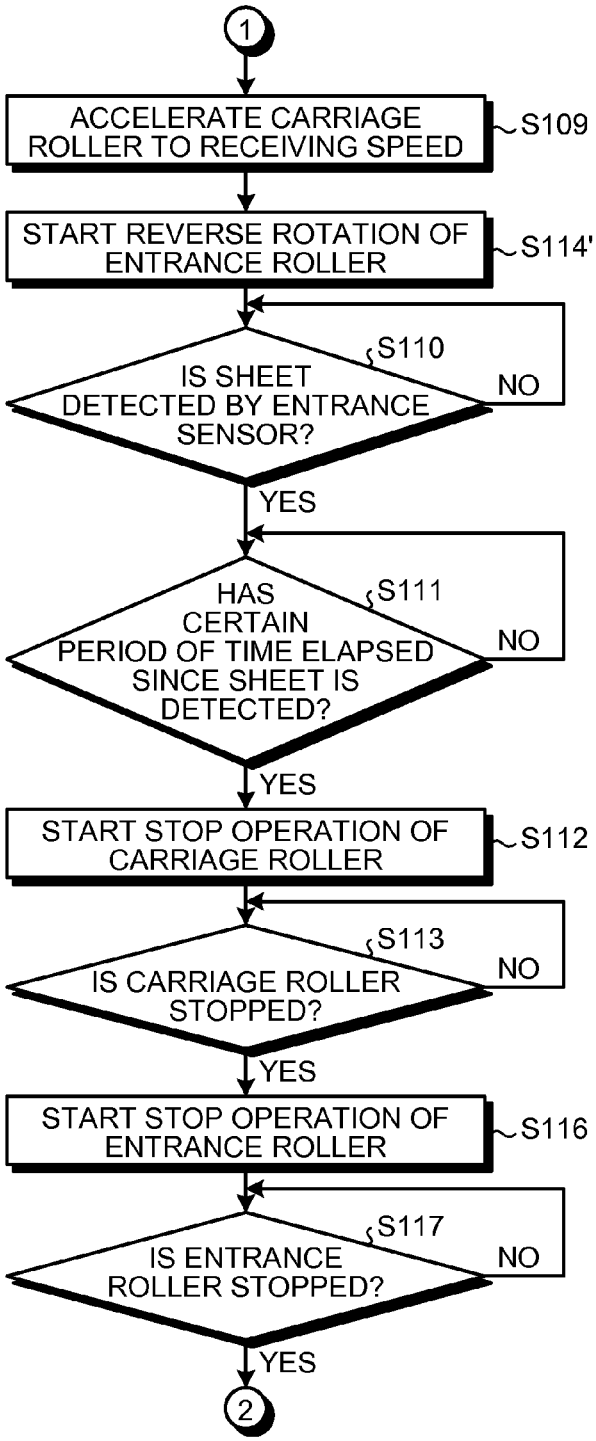
FIG. 16 is a flowchart illustrating another example of the process of the skew correction in the control configuration in FIG. 14.

In FIG. 15, the entrance roller 1 functioning as a registration roller is stopped until Step S114, and starts to rotate reversely after the leading edge Pb abuts on the entrance roller 1. Instead of this control, the skew also can be corrected by rotating the entrance roller 1 reversely before the leading edge Pb abuts on the entrance roller 1. FIG. 16 is a flowchart illustrating a process of the control described above, and can be substituted for the process from Step S109 to Step S117 in FIG. 15. In other words, the flowchart in FIG. 16 corresponds to the process between 1 and 2 enclosed within a circle in FIG. 15.

In the control process, if it is determined that the sheet is not the normal paper at Step S102 in FIG. 15, the carriage roller 1' is accelerated to the sheet receiving speed at Step S109 in FIG. 16 (same as the processing at Step S109 in FIG. 15), and reverse rotation of the entrance roller 1 is started (Step S114'). After the entrance sensor SN1' detects the leading edge of the z-fold paper Pz (Yes at Step S110), the z-fold paper Pz is simply conveyed (refer to FIGS. 12A and 12B and FIGS. 13A and 13B). If a certain period of time elapses (Yes at Step S111), the stop operation of the carriage roller 1' is started (Step S112). The certain period of time is obtained by adding a period of time in which the leading edge Pb of the z-fold paper Pz evenly abuts on the vicinity of the nips of the entrance rollers 1 on the one side and the other side to a period of time long enough to ensure the flexure amount of the flexure Pa required for skew correction of the leading edge Pb of the z-fold paper Pz. The certain period of time can be replaced by a certain conveying amount as in the case in FIG. 15.

If the carriage roller 1' stops (Yes at Step S113) (refer to FIGS. 11A and 11B), a stop operation of the reverse rotation of the entrance roller 1 is started (Step S116). If the entrance roller 1 stops (Yes at Step S117), acceleration processing of the carriage roller 1' and the entrance roller 1 to the receiving speed for the z-fold paper Pz is started (Step S108). Thus, the z-fold paper Pz is conveyed from the state illustrated in FIGS. 11A and 11B, whereby the skew of the z-fold paper Pz is corrected.

At Step S105 and Step S111 in FIG. 15, and at Step S111 in FIG. 16, it is determined whether the certain period of time elapses after the entrance sensor SN1' detects the leading edge Pb of the normal paper P or the z-fold paper Pz. The certain period of time is set depending on the types of the sheet, such as the sheet size and the sheet thickness. In the present embodiment, the flexure amount required for skew correction is measured in advance depending on the types of the sheet, such as the sheet size and the sheet thickness. Based on the measured values, data of a period of time (conveying amount) required for forming the flexure Pa is stored in a storage unit such as an electrically erasable programmable read-only memory (EEPROM) in the control circuit 380 as a table, for example. When performing processing in accordance with the flowchart, the CPU 381 sets the certain period of time or the conveying amount required for forming flexure with reference to the table, thereby performing determination at Step S105 and Step S111 based on the period of time and the conveying amount.

The stop operation of the entrance roller 1 at Step S116 in FIG. 15 and FIG. 16 is started depending on the correction amount of the skew. Therefore, data of the relationship between the time from the start of the reverse rotation of the entrance roller 1 to the start of the stop operation thereof and the skew amount is measured depending on the sheet size in advance, and is stored as a table in the same manner as of the flexure amount, for example. Thus, the CPU 381 can set the time from the start of the reverse rotation of the entrance roller 1 to the start of the stop operation thereof based on the data thus stored as a table.

If no data stored as a table is used, the skew amount of the z-fold paper Pz may be detected to set the start timing of the stop operation of the reverse rotation based on the skew amount thus detected. In the present embodiment, a skew detection sensor that detects the skew amount is arranged in the conveying path A to detect the skew amount of the z-fold paper Pz being conveyed. Thus, the start timing of the stop operation is set based on the detected skew amount.

Figure 17A:
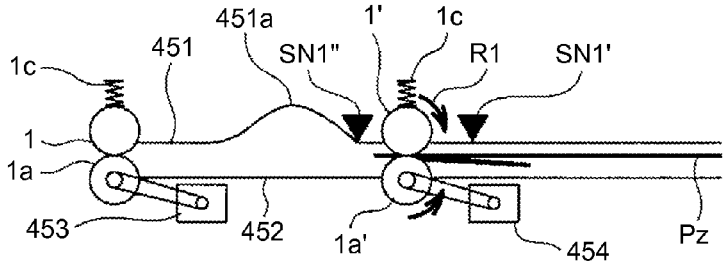
FIGS. 17A and 17B are schematics obtained by providing a skew detection sensor to the example in FIGS. 9A and 9B and for explaining skew correction performed based on the detected skew amount, and illustrate a state in which the z-fold paper enters.
Figure 17B:
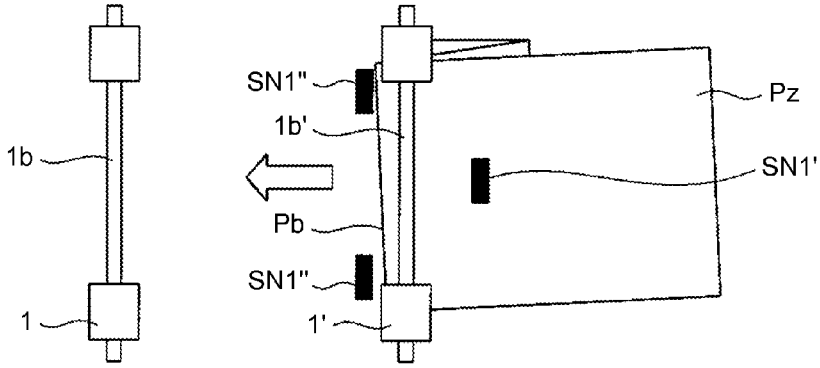
Figure 18A:
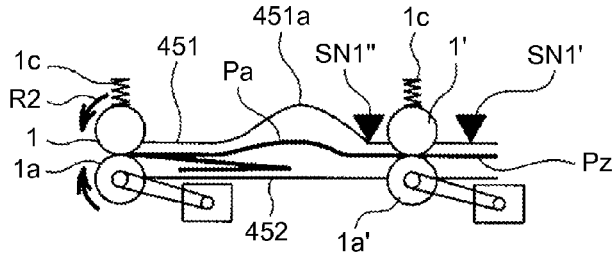
FIGS. 18A and 18B are schematics obtained by providing the skew detection sensor to the example in FIGS. 9A and 9B and for explaining the skew correction performed based on the skew amount thus detected, and illustrate a state in which skew of the z-fold paper is being corrected.
Figure 18B:
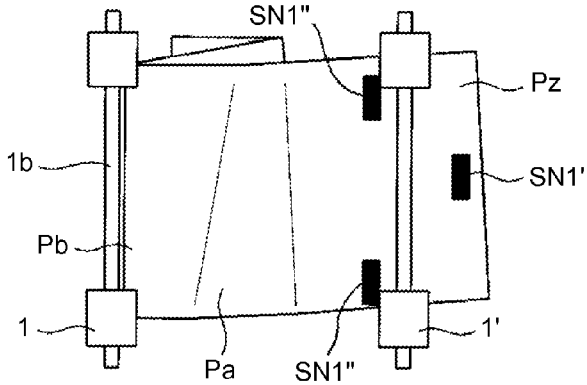

FIGS. 17A and 17B and FIGS. 18A and 18B are schematics for explaining a skew correction device including a skew detection sensor that detects the skew amount and an operation thereof. FIGS. 17A and 17B illustrate a state in which the z-fold paper Pz is nipped by the carriage roller 1' and starts to be conveyed. FIGS. 18A and 18B illustrate a state in which the z-fold paper Pz abuts on the nip of the entrance roller 1 or on the vicinity of the nip.

In the example illustrated in FIGS. 17A and 17B and FIGS. 18A and 18B, a pair of skew detection sensors SN1" is arranged at a position adjacent to and on the downstream of the carriage roller 1' in addition to the entrance sensor SN1' arranged on the upstream of the carriage roller 1'. The skew detection sensors SN1" are arranged at positions equally distant from the carriage rollers 1' on the one side and the other side, respectively. Based on difference between detection timings of both the sensors, it is possible to detect the skew amount of the leading edge Pb of the z-fold paper Pz.

Based on the skew amount thus detected, the CPU 381 adjusts the period of time for stopping the carriage roller 1' (period of time from Step S112 to Step S108), thereby changing the abutting amount. Furthermore, based on the skew amount thus detected, the CPU 381 adjusts the period of time or the amount for rotating the entrance roller 1 reversely. In other words, based on the skew amount thus detected, at least one of the abutting amount on the entrance roller 1 and the reverse rotation amount of the entrance roller 1 is reduced for the normal paper P or the z-fold paper Pz having a little skew amount. By contrast, at least one of the abutting amount on the entrance roller 1 and the reverse rotation amount of the entrance roller 1 is increased for the normal paper P or the z-fold paper Pz having a large skew amount.

The skew detection sensor SN1" is formed of a photosensor. While a reflective photosensor is arranged on the upper conveyance guiding plate 451 on the upper side of the conveying path A in FIG. 17A and FIG. 18A, the photosensor may be a light-reflective sensor or a light-transmissive sensor. If the photosensor is a light-reflective sensor, the photosensor detects the passing timing of the leading edge Pb from a change in the reflectivity caused by the z-fold paper Pz passing by the photosensor. By contrast, if the photosensor is a light-transmissive sensor, the photosensor detects the passing timing of the leading edge Pb from an operational timing at which the leading edge Pb of the z-fold paper Pz blocks the optical path.

The sheet bundle constituting one copy is not necessarily composed of the normal paper P alone on which no folding is performed or the z-fold paper Pz alone on which z-fold processing is performed, and is likely to include both the pieces of paper. Furthermore, unless particular control is performed, the image forming apparatus PR usually forms an image at the same operational timing regardless of normal paper or folded paper, and conveys the sheet on which the image is formed to the folding apparatus ZF. The folding apparatus ZF conveys the normal paper P on which no folding (z-fold processing in the present embodiment) is performed directly to the sheet post-processing apparatus FR through the eighth conveying path 108. Therefore, before the skew correction of the z-fold paper Pz conveyed previously is completed, subsequently conveyed normal paper P on which no folding is performed reaches the skew correction position in the sheet post-processing apparatus FR. In such a state, not only no skew correction is performed on the normal paper P, which is the subsequent paper, but also a sheet jam occurs at the skew correction position.

To address this, in the present embodiment, if the normal sheet P on which no folding is performed is conveyed subsequently to the z-fold paper Pz, the conveying path is changed such that the conveying time of the normal sheet P is made longer in the folding apparatus ZF. In other words, the conveying time in the folding apparatus ZF is used as a buffer to adjust the time when the normal paper P reaches the skew correction position, thereby preventing an interval between the preceding z-fold paper Pz and the normal paper P from being too short. Thus, it is possible to prevent a sheet jam from occurring.

Specifically, if the preceding paper is the z-fold paper Pz, and the following paper is the normal paper P on which no folding is performed, the following normal paper P ejected from the image forming apparatus PR is conveyed to the folding apparatus ZF, and passes through the entrance 221, the first conveying path 101, the fourth conveying path 104, and the conveying path on the downstream of the seventh conveying path 107, and is ejected from the exit 222 to the sheet post-processing apparatus FR. The CPU 361 controls the first and the second switching claws 301 and 302, the first and the second pairs of folding rollers 201 and 202, the rollers 231, 235, 242, and 212, and the like arranged along the path, thereby introducing the normal sheet P into the sheet post-processing apparatus FR. A normal sheet P subsequent to the following normal sheet P is also conveyed with the same interval interposed therebetween. Therefore, the normal sheet P subsequent to the following normal sheet P is also caused to pass through the first conveying path 101, the fourth conveying path 104, and the conveying path on the downstream of the seventh conveying path 107 without passing though the straight conveying path directly from the entrance 221 to the exit 222. Thus, the interval between the pieces of paper is ensured.

As described above, according to the present embodiment, because the productivity is reduced if the skew correction is performed on the normal paper P on which no folding is performed by reversely rotating the entrance roller (registration roller) 1, normal skew correction in which the entrance roller 1 is stopped is performed on the normal paper P. By contrast, the entrance roller 1 is rotated reversely only for the z-fold paper (sheet on which z-fold processing is performed) Pz. With this configuration, even if the leading edge Pb of the z-fold paper Pz is nipped unevenly, skew correction can be performed, thereby obtaining advantageous effects of the skew correction. Furthermore, fluctuation in the skew correction is made small.

In terms of the z-fold paper Pz, because the interval is longer than that of the normal paper P on which no folding is performed, the reverse rotation of the entrance roller 1 is less likely to reduce the productivity. Therefore, in the present embodiment, the entrance roller 1 is not rotated reversely except for the z-fold paper Pz, and the skew correction by the reverse rotation of the entrance roller 1 is performed only on the z-fold paper Pz. As a result, it is possible not only to maintain the productivity, but also to improve the accuracy in the skew correction of the z-fold paper Pz.

In the present embodiment, the entrance roller 1 and the carriage roller 1' function as a pair, and the entrance roller 1 functions as a registration roller. Alternatively, for example, the carriage roller 2 illustrated in FIG. 6 may be a registration roller specified as a function of the entrance roller 1 of the present embodiment, and the entrance roller 1 may function as the carriage roller 1' of the present embodiment. In this case, it is obviously necessary to provide a bulging portion similar to the bulging portion 451*a* illustrated in FIG. 7A to an upper conveyance guiding plate of upper and lower conveyance guiding plates on which the carriage rollers 2 is arranged.

In the present embodiment, the z-fold paper Pz is exemplified as the sheet on which folding is performed. This is because punching processing is exemplified as the post-processing performed on the sheet on which folding is performed. However, the folding is not limited to the z-fold processing, and if it is required to use the registration roller for alignment, the present embodiment can be applied to a sheet on which other fold processing is performed.

According to the embodiments, it is possible to improve skew correction performance for a sheet on which folding is performed without reducing the productivity of the sheet on which folding is performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A skew correction device comprising:

a first conveying unit arranged in a sheet conveying path;

a second conveying unit arranged downstream of the first conveying unit in a conveying direction of a sheet; and a skew correction unit configured to control driving of the first conveying unit and the second conveying unit to correct for skew of the sheet, wherein when the sheet is unfolded paper, the skew correction unit performs a first skew correction that corrects for the skew of the sheet so that a leading edge of the sheet conveyed by the first conveying unit abuts on the second conveying unit that is stopped, and when the sheet is fold paper, the skew correction unit performs a second skew correction that corrects for the skew of the sheet so that a leading edge of the sheet conveyed by the first conveying unit abuts the second conveying unit and the second conveying unit is driven in a reverse direction to the conveying direction at a predetermined operational timing.

2. The skew correction device according to claim 1, further comprising:

a determination unit that determines whether a sheet that is subjected to skew correction is unfolded paper or fold paper, wherein the skew correction unit performs one of the first skew correction and the second skew correction based on a determination result of the determination unit.

3. The skew correction device according to claim 1, wherein the predetermined operational timing is a time after the leading edge of the sheet reaches the second conveying unit.

4. The skew correction device according to claim 1, wherein the predetermined operational timing is a time just before the leading edge of the sheet reaches the second conveying unit.

5. The skew correction device according to claim 1, wherein the predetermined operational timing is a time before the sheet reaches the first conveying unit.

6. The skew correction device according to claim 1, further comprising:

a detection unit configured to detect a skew amount of the sheet conveyed by the first conveying unit, wherein the skew correction unit controls a conveying amount of the sheet in accordance with the detected skew amount.

7. The skew correction device according to claim 1, further comprising:

a detection unit configured to detect a skew amount of the sheet conveyed by the first conveying unit, wherein the skew correction unit controls a driving amount of the second conveying unit in the reverse direction in accordance with the detected skew amount.

8. A sheet handling apparatus comprising the skew correction device according to claim 1.

9. An image forming system comprising:

the skew correction device according to claim 1; and an image forming apparatus configured to form an image on the sheet.

10. The image forming system according to claim 9, further comprising an adjustment unit configured to adjust an interval at which a sheet of fold paper and a sheet of unfolded paper following the sheet of fold paper are conveyed so that the interval is longer than an interval at which sheets of unfolded paper are sequentially conveyed in a manner that switches a conveying path on upstream of the skew correction device.

* * * * *